US007088313B2

(12) United States Patent
Kang

(10) Patent No.: US 7,088,313 B2
(45) Date of Patent: Aug. 8, 2006

(54) METHOD AND APPARATUS FOR COMPENSATING WHITE BALANCE OF PLASMA DISPLAY PANEL

(75) Inventor: Seong Ho Kang, Daegu (KR)

(73) Assignee: LG Electronics Inc., Seoul (KR)

( * ) Notice: Subject to any disclaimer, the term of this patent is extended or adjusted under 35 U.S.C. 154(b) by 221 days.

(21) Appl. No.: 10/359,595

(22) Filed: Feb. 7, 2003

(65) Prior Publication Data

US 2003/0184500 A1 Oct. 2, 2003

(30) Foreign Application Priority Data

Feb. 9, 2002 (KR) ..... 10-2002-0007670

(51) Int. Cl.
*G09G 3/38* (2006.01)

(52) U.S. Cl. ..... 345/60; 345/63; 345/66; 345/67; 345/69

(58) Field of Classification Search ..... 345/63, 345/690–693, 60, 147, 148, 55, 66–69, 613, 345/612, 600, 204; 353/97, 101; 348/647, 348/675; 315/169.4
See application file for complete search history.

(56) References Cited

U.S. PATENT DOCUMENTS 5,526,058 A * 6/1996 Sano et al. ..... 348/647
5,583,527 A * 12/1996 Fujisaki et al. ..... 345/55
5,597,223 A * 1/1997 Watanabe et al. ..... 353/97
5,856,823 A * 1/1999 Kimoto et al. ..... 345/600
6,034,655 A * 3/2000 You ..... 345/60
6,323,880 B1 * 11/2001 Yamada ..... 345/690
6,340,867 B1 * 1/2002 Kang ..... 315/169.4
6,362,800 B1 * 3/2002 Moon ..... 345/60
6,388,678 B1 * 5/2002 Kasahara et al. ..... 345/690
6,414,658 B1 * 7/2002 Tokunaga ..... 345/63
6,473,061 B1 * 10/2002 Lim et al. ..... 345/60
6,518,977 B1 * 2/2003 Naka et al. ..... 345/690
6,703,990 B1 * 3/2004 Tokunaga et al. ..... 345/60
6,812,932 B1 * 11/2004 Kasahara et al. ..... 345/613
6,903,514 B1 * 6/2005 Yun et al. ..... 315/169.4

(Continued)

FOREIGN PATENT DOCUMENTS

JP 10013849 1/1998

(Continued)

OTHER PUBLICATIONS

Korean Office Action dated Apr. 8, 2004.

(Continued)

*Primary Examiner*—Vijay Shankar
*Assistant Examiner*—Prabodh Dharia
(74) *Attorney, Agent, or Firm*—Fleshner & Kim, LLP

(57) ABSTRACT

A white balance compensating method of a plasma display panel includes detecting an average brightness of an input data; determining a discharge frequency in accordance with the average brightness of the data; and applying gamma correction to the data in consideration of the discharge frequency. A white balance compensating apparatus of a plasma display panel includes an average picture level controller for detecting an average brightness of an input data and determining a discharge frequency in accordance with the average brightness of the data; and a gamma corrector for applying gamma correction to the data in consideration of the discharge frequency.

32 Claims, 6 Drawing Sheets

U.S. PATENT DOCUMENTS

2001/0020924 A1* 9/2001 Makino ..... 345/60
2002/0008679 A1* 1/2002 Rutherford ..... 345/60
2002/0122019 A1* 9/2002 Baba et al. ..... 345/88
2002/0158819 A1* 10/2002 Lee et al. ..... 345/60
2002/0175922 A1* 11/2002 Koo et al. ..... 345/589
2003/0011563 A1* 1/2003 Wada ..... 345/156
2003/0080927 A1* 5/2003 Sim et al. ..... 345/60
2003/0222863 A1* 12/2003 Yun eta l. ..... 345/204
2004/0066356 A1* 4/2004 Yun et al. ..... 345/60
2004/0135748 A1* 7/2004 Yoon et al. ..... 345/60
2005/0088370 A1* 4/2005 Shigeta et al. ..... 345/60
2005/0128167 A1* 6/2005 Yoon et al. ..... 345/60

FOREIGN PATENT DOCUMENTS

KR 20010088300 9/2001

OTHER PUBLICATIONS

Hiroshi Murakami: "Driving Technologies and Picture Quality of PDPs," *IEEE*, pp. 62-68, 2003.

* cited by examiner

METHOD AND APPARATUS FOR COMPENSATING WHITE BALANCE OF PLASMA DISPLAY PANEL

BACKGROUND OF THE INVENTION

1. Field of the Invention

The present invention relates to a plasma display panel, and more particularly to a method and an apparatus for compensating the white balance of a plasma display panel in order to improve its picture quality.

2. Description of the Related Art

A plasma display panel PDP displays a picture in use of the visible ray generated from a phosphorus material when the phosphorus material is excited by the ultraviolet ray generated by a gas discharge. The PDP has advantages that it is thinner and lighter than a cathode ray tube CRT, which has been a display means most widely used so far, and it is possible to be made into a high definition screen and bigger in size.

The PDP is driven by dividing one frame into several sub-fields that have different light emission frequency, for realizing the gray level of a picture. Each sub-field can be divided again into a reset period for generating a uniform discharge, an address period for selecting discharge cells and a sustain period for realizing gray levels in accordance with a discharge frequency For instance, in the event that it is wanted to display a picture with 256 gray levels, a frame period 16.67 ms corresponding to 1/60 second is divided into 8 sub-fields. In addition, each of 8 sub-fields is divided again into the reset period, the address period and the sustain period. Herein, the reset period and the address period of a sub-field are the same for each sub-field, but on the other hand, the sustain period and the discharge frequency thereof increase in proportion of the number of sustain pulses at the rate of 2n (n=0,1,2,3,4,5,6,7) in each sub-field. In this way, since the sustain period becomes different in each sub-field, it is possible to realize the gray level of a picture.

There is included a circuit that compensates white balance for increasing display quality in this PDP.

Referring to FIG. 1, a conventional PDP driving circuit includes gamma correctors 2R, 2G and 2B each receiving video data of red, green and blue, and gain controllers 4R, 4G and 4B, error diffusers 6R, 6G and 6B and sub-field mapping units 8R, 8G and 8B connected between the gamma correctors 2R, 2G and 2B and a data driver of the PDP.

The gamma correctors 2R, 2G and 2B apply reverse gamma correction to the video data of red, green and blue to linearly convert brightness values in accordance with gray level values of the video data. To this end, the gamma correctors 2R, 2G and 2B apply gamma correction to the data of red, green and blue by equally raising them to the 2.2 power. The ratio of the red, green and blue data is set to be 0.8:1:1.2 to have correct white balance.

$$\gamma(R, G, B) = \left(\frac{\text{input data}}{255}\right)^{2.2}. \qquad \text{Formula 1}$$

The gain controllers 4R, 4G and 4B adjust gains by multiplying values by the red, green and blue video data corrected by the gamma correctors 2R, 2G and 2B, wherein the values are set in advance at the rate of white balance as in FIG. 3.

The error diffusers 6R, 6G and 6B finely adjust brightness values by diffusing error components to adjacent cells with respect to the data from the gain controllers 4R, 4G and 4B. To this end, the error diffusers 6R, 6G and 6B separate the data into integer parts and fractional parts, and multiply the fractional parts by Floy-Steinberg coefficient to diffuse the error components to the adjacent cells thereto.

The sub-field mapping units 8R, 8G and 8B map the data inputted from the error diffusers to a sub field pattern that is set in advance so as to apply them to a data aligner 12.

The data aligner 12 stores the video data, which are inputted from the sub field mapping units 8R, 8G and 8B, at a memory 10, and at the same time, retrieves the data stored at the memory 10 to apply to the data driver of the PDP (not shown).

The data driver of the PDP is implemented as integrated circuits IC each connected to each of a plurality of data lines formed in the PDP, and applies the data inputted from the data aligner 12 to the data lines of the PDP.

FIG. 4 illustrates another driving circuit of a conventional PDP.

Referring to FIG. 4, the driving circuit of the conventional PDP includes an average picture level APL controller 20 for detecting the average brightness of input images per frame, and a gain controller 4 for adjusting gains with respect to the red, green and blue video data inputted from the gamma corrector 2A in accordance with the APL detected by the APL controller 20.

The APL detected by the APL controller 20 is inputted to the gain controller 4 and to a timing controller (not shown) at the same time. The timing controller controls a circuit to have the number of sustain pulses adjusted, wherein the circuit generates the sustain pulses.

The frame memory 14 acts to delay the data inputted from an input line for one frame period and to apply them to the gamma corrector 2A. With regard to the gamma corrector 2A and 2B, the error diffuser 6, the sub-field mapping unit 8, the data aligner 12 and memory 10, they substantially have the same functions as those shown in FIG. 1, thus their detail description will be omitted.

By the way, because the saturation characteristic of red, green and blue phosphoruses, which vary with discharge frequency, is not considered in the conventional PDP driving circuit, there is a problem that desired colors are not expressed in accordance with the APL or the discharge frequency.

To describe this in detail, the composition of red phosphorus generally used in the PDP is YgdBO3:Eu3+, the composition of green phosphorus is Zn2SiO4:Mn2+, and the composition of blue phosphorus is BaMgA1110017:Eu2+. According to the experiment result, the saturation characteristics of the red, green and blue phosphoruses in accordance with the discharge frequency as in FIG. 5 come to be different. In other words, the blue phosphorus has its brightness proportional to the discharge frequency, the red phosphorus has its brightness proportional to about (discharge frequency)$^{0.9}$, and the blue phosphorus has its brightness proportional to about (discharge frequency)$^{0.85}$. In this way, the brightness saturation characteristic of the blue phosphorus is linear to the discharge frequency, but the brightness saturation characteristics of the red phosphorus and green phosphorus are non-linear to the discharge frequencies. Accordingly, if in theory, gamma correction is applied to the red, green and blue video data by raising them to the 2.2 power, the gray level values should be expressed as normal. However, in practice, the gray levels can be expressed only when the gamma correction is applied to each of the red, green and blue data with their optimal values due to the different saturation characteristic of phosphorus by red, green and blue.

As described above, the saturation characteristic of phosphorus is different by red, green and blue, thus the white balance in accordance with the discharge frequency is not the same. For instance, yellowish white color appears if the discharge frequency is several hundreds when displaying white color, and bluish white color appears if the discharge frequency is increased to several thousands. This problem cannot be solved in the conventional driving circuit. In other words, the reference values of the gain adjustment and gamma correction set in the PDP driving circuit as in FIG. 1 are fixed to the values for which the discharge frequency was not taken into consideration. In the driving circuit of the PDP as in FIG. 4, the gains of the red, green and blue video data are adjusted in a fixed rate of the white balance that is set in advance regardless of the discharge frequency even though the gains are adjusted in accordance with the APL value. More specifically, in the event that the number of sustain pulses is adjusted in accordance with the APL value, if the number of sustain pulses is decreased to a few hundreds in a Full White Pattern where the full screen is displayed in white as in FIG. 6A, the yellowish white color appears according to the different saturation characteristics of the red, green and blue phosphoruses, and the bluish white color appears in a white color area if the number of sustain pulses is increased to several thousands in a Window Pattern where part of the screen is displayed in white as in FIG. 6B.

SUMMARY OF THE INVENTION

Accordingly, it is an object of the present invention to provide a method and an apparatus for compensating the white balance of a plasma display panel in order to improve its picture quality.

In order to achieve these and other objects of the invention, a white balance compensating method of a plasma display panel according to an aspect of the present invention includes steps of detecting an average brightness of an input data; determining a discharge frequency in accordance with the average brightness of the data; and applying gamma correction to the data in consideration of the discharge frequency.

In the step of applying gamma correction, the gamma correction is differently applied to red, green and blue data if the discharge frequency is a first number.

In the step of applying gamma correction, if the discharge frequency is the first number, the red data are raised to the about 2.8 power, the green data are raised to the about 2.9 power and the blue data are raised to the about 2.6 power.

Herein, the first number is about several hundreds.

Herein, the first number is determined when the value of the average brightness is about 10%.

In the step of applying gamma correction, if the discharge frequency is a second number, the blue data are adjusted differently from other color data.

In the step of applying gamma correction, if the discharge frequency is the second number, the red data and green data are raised to the about 2.3 power and the blue data are raised to the about 2.2 power.

Herein, the second number is about a thousand.

Herein, the first number is determined when the value of the average brightness is about 90%.

The white balance compensating method further includes a step of applying standard gamma correction to red, green and blue data equally.

In the step of detecting the average brightness of the data, the average brightness is detected with respect to the data to which the standard gamma correction is applied.

The white balance compensating method further includes steps of adjusting the gain of the data; and diffusing errors with respect to the data, the gain of which is adjusted.

A white balance compensating method of a plasma display panel according to another aspect of the present invention includes steps of detecting an average brightness of an input data; determining a discharge frequency in accordance with the average brightness of the data; and applying gamma correction to the data differently by red, green and blue in accordance with the discharge frequency.

A white balance compensating apparatus of a plasma display panel according to still another aspect of the present invention includes an average picture level controller for detecting an average brightness of an input data and determining a discharge frequency in accordance with the average brightness of the data; and a gamma corrector for applying gamma correction to the data in consideration of the discharge frequency.

Herein, the gamma corrector differently applies gamma correction to red, green and blue data if the discharge frequency is about several hundreds.

Herein, if the discharge frequency is about several hundreds, the gamma corrector has the red data raised to the about 2.8 power, the green data raised to the about 2.9 power and the blue data raised to the about 2.6 power.

Herein, if the discharge frequency is about a thousand, the gamma corrector adjusts the blue data differently from other color data.

Herein, if the discharge frequency is about a thousand, the gamma corrector has the red data and green data raised to the about 2.3 power and the blue data raised to the about 2.2 power.

The white balance compensating apparatus further includes a standard gamma corrector applying standard gamma correction to red, green and blue data equally.

The white balance compensating apparatus further includes a gain controller for adjusting the gain of the data; and an error diffuser for diffusing errors with respect to the data, the gain of which is adjusted.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Reference will now be made in detail to the preferred embodiments of the present invention, examples of which are illustrated in the accompanying drawings.

Figure 1:
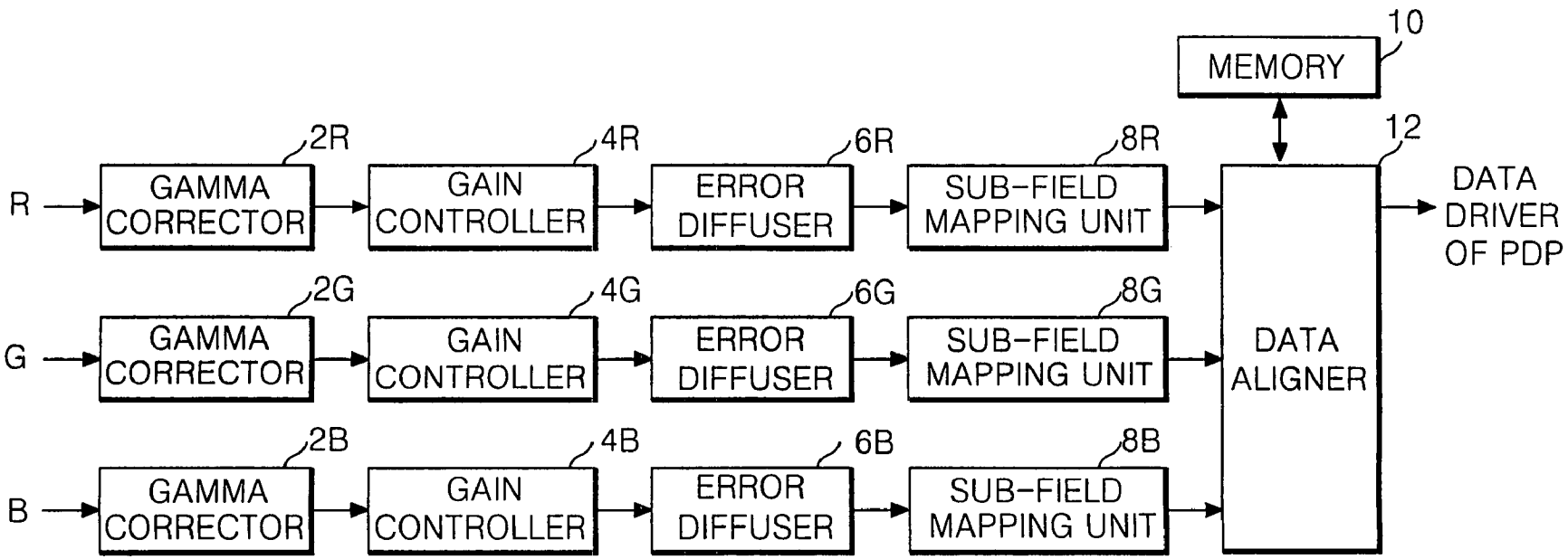
FIG. 1 RELATED ART
FIG. 1 is a schematic block diagram of a plasma display panel driving apparatus of the prior art.
Figure 2:
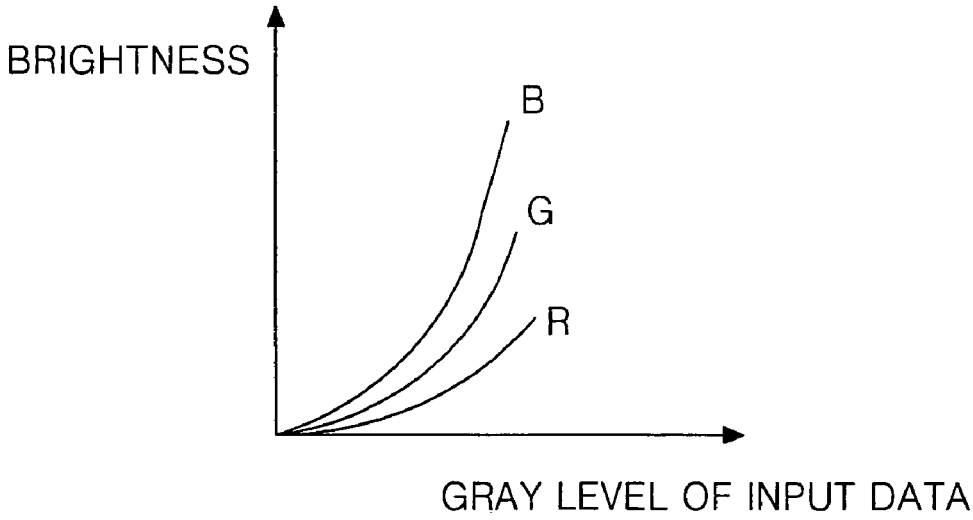
FIG.2 RELATED ART
FIG. 2 illustrates a graph of a conventional gamma correction.
Figure 3:
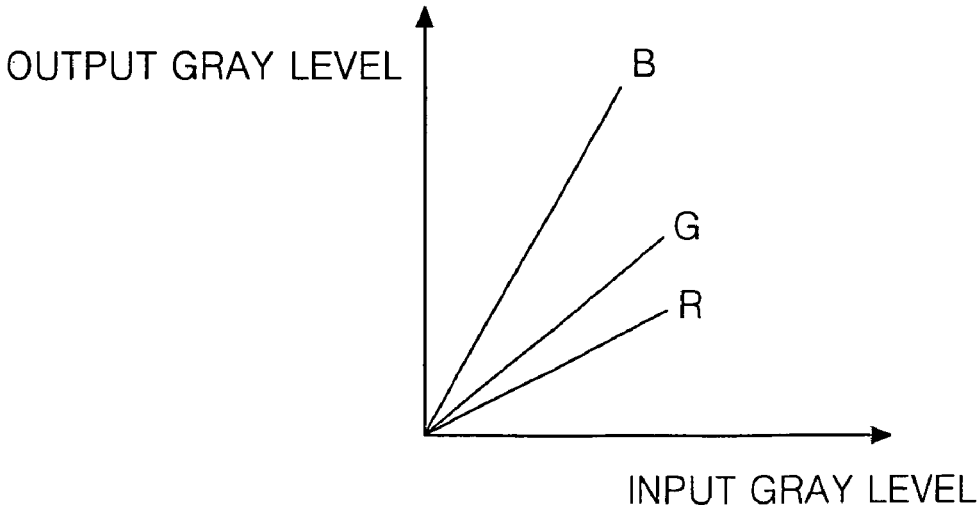
FIG.3 RELATED ART
FIG. 3 illustrates a graph of a conventional gain adjustment.
Figure 4:
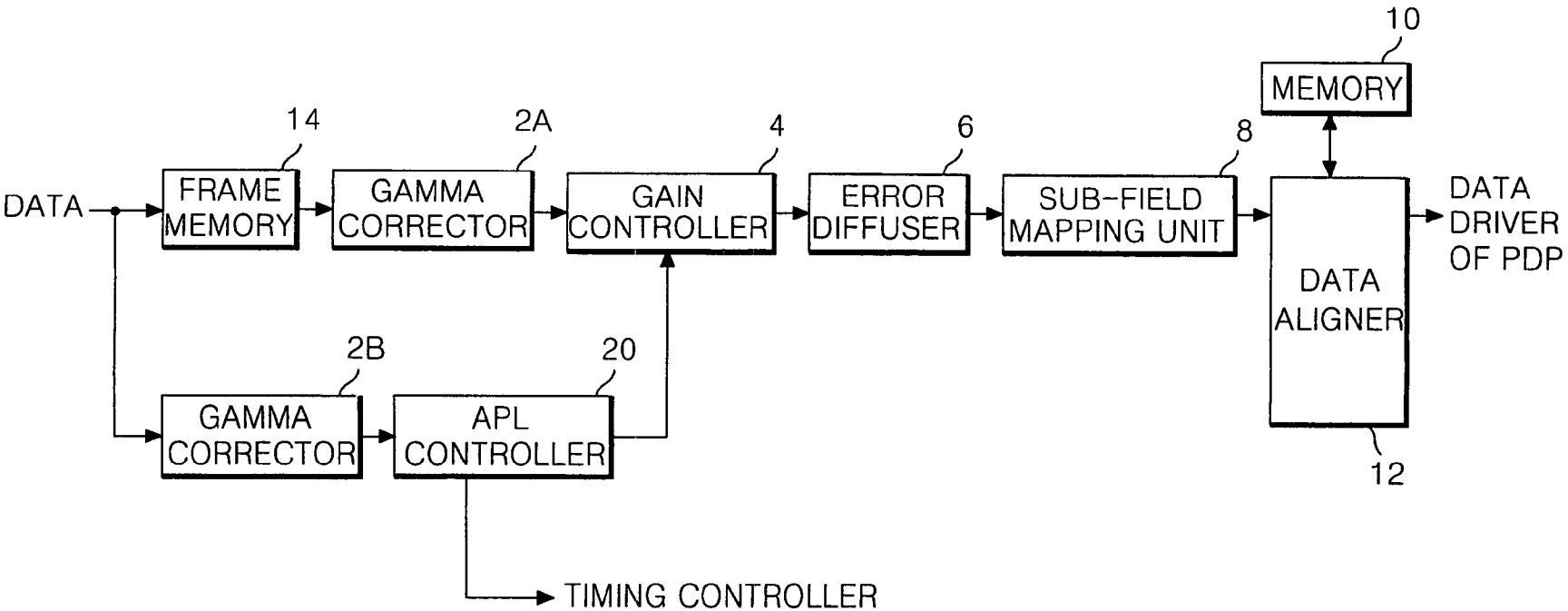
FIG. 4 RELATED ART
FIG. 4 illustrates a schematic block diagram of another plasma display panel driving apparatus of the prior art.
Figure 5:
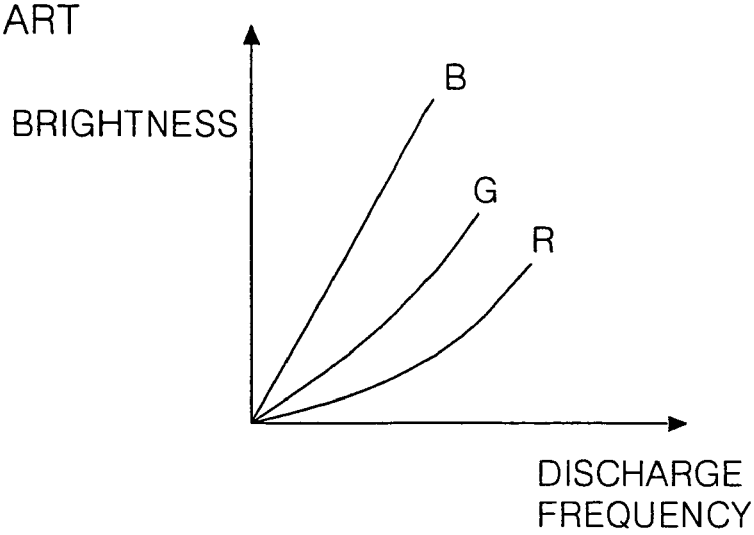
FIG.5 RELATED ART
FIG. 5 is a graph representing a saturation characteristic of phosphorus in accordance with discharge frequency.
Figure 6A:
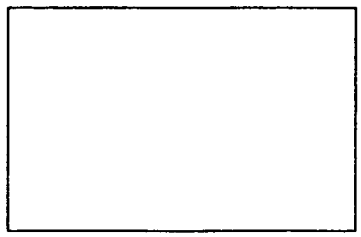
FIG.6A RELATED ART
FIG. 6A illustrates a full white pattern in a diagram.
Figure 6B:
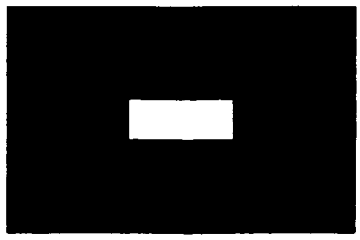
FIG.6B RELATED ART
FIG. 6B illustrates a window pattern in a diagram.
Figure 7:
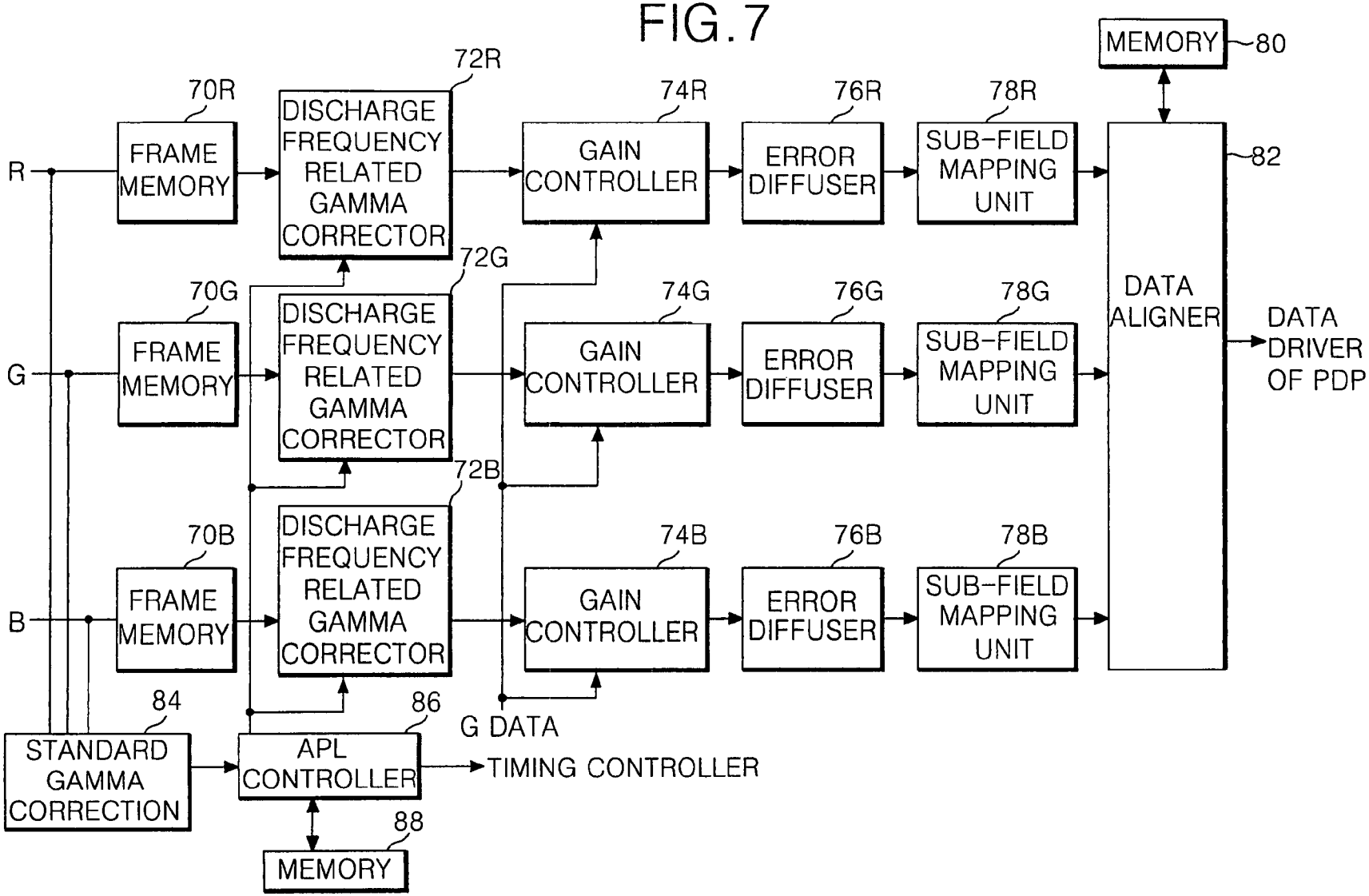
FIG. 7 illustrates a schematic block diagram of a driving apparatus of a plasma display panel according to an embodiment of the present invention.

FIG. 7 illustrates a schematic block diagram representing a driving apparatus of a plasma display panel according to an embodiment of the present invention.

Referring to FIG. 7, the driving apparatus of the PDP according to the embodiment of the present invention includes frame memories 70R, 70G and 70B each stored with red, green and blue video data RGB; discharge frequency related gamma correctors 72R, 72G and 72B, gain controllers 74R, 74G and 74B, error diffusers 76R, 76G and 76B and sub field mapping units 78R, 78G and 78B connected between the frame memories 70R, 70G and 70B and a data driver of the PDP; a standard gamma corrector 84 for applying standard gamma correction to the red, green and blue video data RGB; and an APL controller 86 connected between the standard gamma corrector 84 and the discharge frequency related gamma correctors 72R, 72G and 72B.

The frame memories 70R, 70G and 70B are stored with the red, green and blue video data RGB by the frame and apply them to the discharge frequency related gamma correctors 72R, 72G and 72B.

The discharge frequency related gamma correctors 72R, 72G and 72B differently apply gamma correction to red, green and blue in use of the gamma correction value adjusted in accordance with the discharge frequency controlled by the APL controller 86.

If the APL of the video data RGB is 10%, the APL controller 86 sets the discharge frequency for the data RGB as low as about 1000. With respect to the video data RGB, the discharge frequency of which is set low in this way, the discharge frequency related gamma correctors 72R, 72G and 72B apply gamma correction to the red data R by raising them to the about 2.8 power, as shown in Formula 2 to 4, to the green data G by raising them to the about 2.6 power.

If the APL of the video data RGB is 90%, the APL controller 86 sets the discharge frequency for the data RGB as high as about 200. With respect to the video data RGB, the discharge frequency of which is set high in this way, the discharge frequency related gamma correctors 72R, 72G and 72B apply gamma correction to the red and green data R and G by raising them to the about 2.3 power, as shown in Formula 5 to 6, and the blue data B by raising them to the about 2.6 power.

$$\gamma(R) = \left(\frac{\text{input data}}{255}\right)^{2.8}. \quad \text{Formula 2}$$

$$\gamma(G) = \left(\frac{\text{input data}}{255}\right)^{2.9}. \quad \text{Formula 3}$$

$$\gamma(B) = \left(\frac{\text{input data}}{255}\right)^{2.6}. \quad \text{Formula 4}$$

$$\gamma(R, G) = \left(\frac{\text{input data}}{255}\right)^{2.3}. \quad \text{Formula 5}$$

$$\gamma(B) = \left(\frac{\text{input data}}{255}\right)^{2.2}. \quad \text{Formula 6}$$

The gain controller 74R, 74G and 74B adjust gains by multiplying the reference values for gain adjustment set in advance by each of the red, green and blue video data RGB to which gamma correction is applied by the discharge frequency related gamma correctors 72R, 72G and 72B. Herein, the reference values for gain adjustment with respect to the red, green and blue video data RGB can be adjusted by the data Gdata inputted from a user or a Set maker. A user or an administrator of a set maker can set his desired color temperature in use of the gain controllers 74R, 74G and 74B.

The error diffusers 76R, 76G and 76B finely adjust brightness values by diffusing error components to adjacent cells with respect to the data from the gain controllers 74R, 74G and 74B.

The sub field mapping units 78R, 78G and 78B map the data inputted from the error diffusers 76R, 76G and 76B to a sub field pattern that is set in advance so as to them to the data aligner 82.

The data aligner 82 stores the video data RGB, which are inputted from the sub field mapping units 7BR, 78G and 78B, at a memory 80, and at the same time, retrieves the data stored at the memory 80 to apply to the data driver of the PDP (not shown).

The data driver of the PDP is implemented as integrated circuits IC each connected to each of a plurality of data lines formed in the PDP, and applies the data inputted from the data aligner 82 to the data lines of the PDP.

The standard gamma corrector 84 applies reverse gamma correction to the red, green and blue video data RGB by raising them as in Formula 1.

The APL controller 86 detects the average brightness of input images per frame with respect to the data inputted from the standard gamma corrector 84 and retrieves the information of the number of sustain pulses stored in a memory 88 in accordance with the detected average brightness, i.e., APL, so as to apply it to the timing controller (not shown). Further, the APL controller 86 retrieves the gamma correction values, which are set by red, green and blue, corresponding to the detected APL values and applies them to the discharge frequency related gamma correctors 72R, 72G and 72B, thus it controls the discharge frequency related gamma correctors 72R, 72G and 72B. To this end, the memory 88 is stored with a look-up table. The look-up table has the record of the information of the number of sustain pulses that is set in accordance with the APL value and the gamma correction values that are set differently by red, green and blue.

Figure 8:
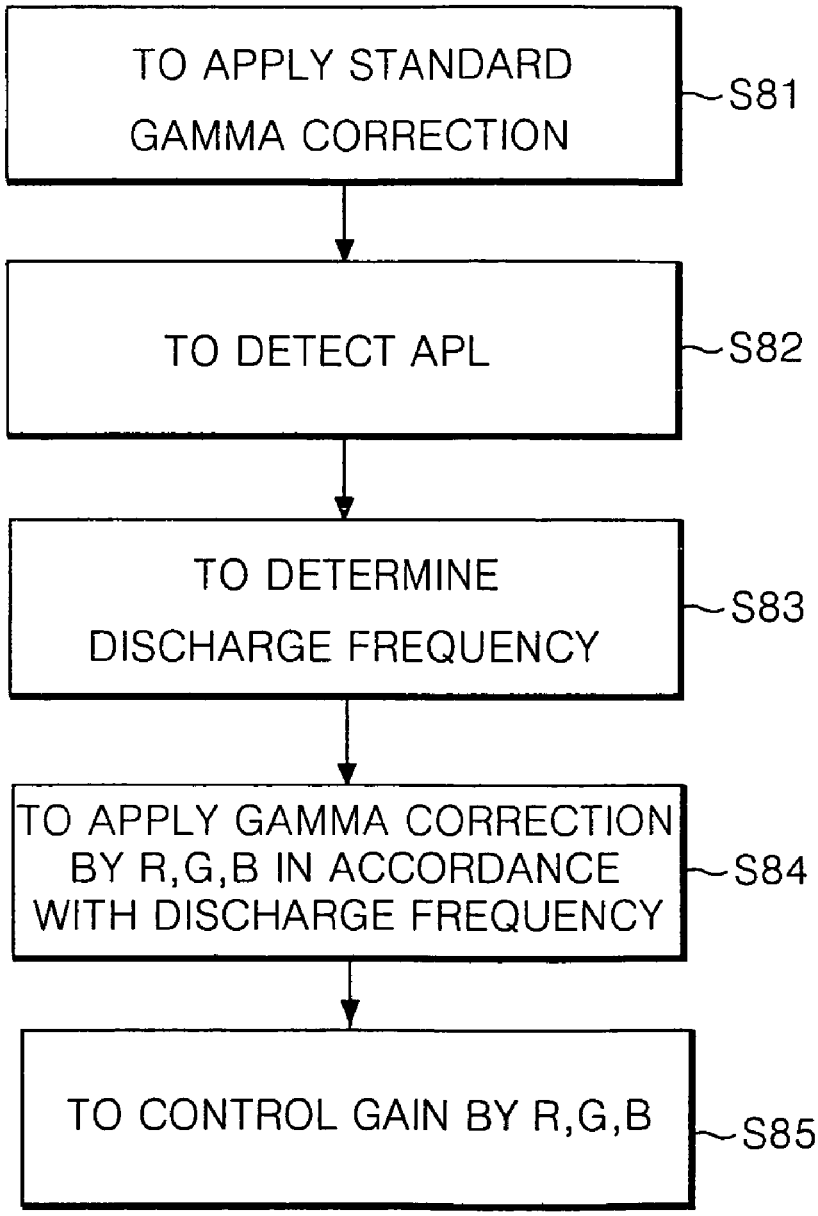
FIG. 8 is a flow chart representing a control sequence of a white balance compensating method of a plasma display panel according to an embodiment of the present invention.

If the control sequence of a white balance compensating method of a PDF according to an embodiment of the present invention is represented as a flow chart, it appears as in FIG. 8.

Referring to FIG. 8, the white balance compensating method of the PDP according to the embodiment of the present invention applies standard gamma correction to input data RGB in use of Formula 1 and detects the average brightness of the input data RGB, i.e., APL (S81 and S82). The white balance compensating method of the PDP according to the embodiment of the present invention determines the discharge frequency in accordance with the APL detected in this way and retrieves the gamma correction values of red, green and blue corresponding to the discharge frequency so as to apply gamma correction to the data by red, green and blue (S83 and S84). Subsequently, the white balance compensating method of the PDP according to the embodiment of the present invention adjusts gains by red, green and blue (S85).

On the other hand, the white balance compensating method and apparatus of the PDP according to the embodiment of the present invention is capable of calculating the gamma correction value in real time in use of an expression where the gamma correction value is a function of the discharge frequency instead of using the foregoing look-up table method.

As described above, the white balance compensating method and apparatus of the PDP according to the present invention implements the gamma correction of red, green and blue in accordance with the discharge frequency in consideration of the saturation characteristic of different phosphoruses by red, green and blue. As a result, the white balance compensating method and apparatus of the PDP according to the present invention sustain the white balance uniformly even when the discharge frequency is different, thus it is possible to improve the picture quality. In the APL control method where the number of sustain pulses is adjusted in accordance with the average brightness of the input image, the white balance compensating method and apparatus of the PDP according to the present invention optimizes the gamma correction values of the red, green and blue data in accordance with the discharge frequency even when there is a big difference in discharge frequency as between a full white pattern and a window pattern, thus the white balance can be sustained uniformly.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A white balance compensating method of a plasma display panel, comprising steps of:

detecting an average brightness of an input data;

determining a discharge frequency in accordance with the average brightness of the data; and applying gamma correction to the data based on the discharge frequency, wherein for a first discharge frequency value a power for red data, a power for green data and a power for blue data are different from one another for the applied gamma correction, and for a second discharge frequency value the power of at least one of the red data, the green data or the blue data is changed for the applied gamma correction.

2. The white balance compensating method according to claim 1, wherein for the first discharge frequency value, the power of the red data is about 2.8 power, the power of the green data is about 2.9 power and the power of the blue data is about 2.6 power.

3. The white balance compensating method according to claim 1, wherein the first discharge frequency value is about several hundreds.

4. The white balance compensating method according to claim 1, wherein the first discharge frequency value is determined when the value of the average brightness is about 90%.

5. The white balance compensating method according to claim 1, wherein for the second discharge frequency value, the blue data are adjusted differently than other color data.

6. The white balance compensating method according to claim 1, wherein for the second discharge frequency value, the power of the red data and green data is about 2.3 power and the power of the blue data is about 2.2 power.

7. The white balance compensating method according to claim 1, wherein the second discharge frequency value is about a thousand.

8. The white balance compensating method according to claim 1, wherein the second discharge frequency value is determined when the value of the average brightness is about 10%.

9. The white balance compensating method according to claim 1, further comprising a step of:

applying standard gamma correction to red, green and blue data equally.

10. The white balance compensating method according to claim 1, wherein in the step of detecting the average brightness of the data, the average brightness is detected with respect to the data to which the standard gamma correction is applied.

11. The white balance compensating method according to claim 1, further comprising steps of:

adjusting the gain of the data; and diffusing errors with respect to the data, the gain of which is adjusted.

12. The white balance compensating method according to claim 1, wherein in the step of applying gamma correction, for the first discharge frequency value, the gamma correction value applied to the green data is the highest, and the gamma correction value applied to the red data is higher than the gamma correction value applied to the blue data.

13. The white balance compensating method according to claim 6, wherein in the step of applying gamma correction, for the second discharge frequency value, the gamma correction value applied to the blue data is lower than gamma correction values applied to the red and green data.

14. The white balance compensating method according to claim 6, wherein the second discharge frequency value is determined when the value of the average brightness is about 90%.

15. A white balance compensating method of a plasma display panel, comprising steps of:

detecting an average brightness of an input data;

determining a discharge frequency in accordance with the average brightness of the data; and applying gamma correction to the data differently by red, green and blue in accordance with the discharge frequency, wherein for a first discharge frequency a power for red data, a power for green data and a power for the blue data are different from one another for the applied gamma correction, and for a second discharge frequency the power of at least one of the red data, the green data or the blue data is changed for the applied gamma correction.

16. A white balance compensating apparatus of a plasma display panel, comprising:

an average picture level controller for detecting an average brightness of an input data and determining a discharge frequency in accordance with the average brightness of the data; and a gamma corrector for applying gamma correction to the data for a first discharge frequency in a first manner and for a second discharge frequency in a second manner different than the first manner, wherein for the first discharge frequency a power for red data, a power for green data and a power for the blue data are different from one another, and for the second discharge frequency the power of at least one of the red data, the green data or the blue data is changed.

17. The white balance compensating apparatus according to claim 16, wherein the gamma corrector differently applies gamma correction to red, green and blue data if the discharge frequency is about several hundreds.

18. The white balance compensating apparatus according to claim 16, wherein if the discharge frequency is about several hundreds, the gamma corrector changes the power of the red data to about 2.8 power, changes the power of the green data to about 2.9 power and changes the power of the blue data to about 2.6 power.

19. The white balance compensating apparatus according to claim 16, wherein if the discharge frequency is about a thousand, the gamma corrector adjusts the blue data differently from other color data.

20. The white balance compensating apparatus according to claim 19, wherein if the discharge frequency is about a thousand, the gamma corrector adjusts the highest gamma correction to the blue data.

21. The white balance compensating apparatus according to claim 16, wherein if the discharge frequency is about a thousand, the gamma corrector changes the power of the red data and green data to about 2.3 power and changes the power of the blue data to about 2.2 power.

22. The white balance compensating apparatus according to claim 16, further comprising:

a standard gamma corrector applying standard gamma correction to red, green and blue data equally.

23. The white balance compensating apparatus according to claim 16, further comprising:

a gain controller for adjusting the gain of the data; and an error diffuser for diffusing errors with respect to the data, the gain of which is adjusted.

24. The white balance compensating apparatus according to claim 16, wherein the gamma corrector applies the highest gamma correction to the green data and the next highest gamma correction to the red data if the discharge frequency is about several hundreds.

25. A method for driving a display panel, comprising:

performing a first gamma correction for a first discharge frequency in which a power for red data, a power for green data and a power for blue data are different from one another; and performing a second gamma correction for a second discharge frequency in which the power of one of the red data, the green data or the blue data is changed from the first gamma correction.

26. The method of claim 25, wherein the first gamma correction is performed prior to the second gamma correction.

27. The method of claim 25, further comprising determining a brightness of input data based on an input signal, wherein the discharge frequency is based on the determined brightness.

28. The method of claim 27, wherein the brightness is the average brightness of the input data.

29. The method of claim 28, wherein the input signal comprises at least one of a red, green and blue input signals.

30. The method of claim 25, wherein the first and second gamma corrections raise the input data to at least one given power according to at least one formula.

31. A display panel, comprising:

a first gamma corrector for applying standard gamma correction to an input data; and a second gamma corrector for applying changed gamma correction to the input data in consideration of a discharge frequency, wherein for the standard gamma correction a power for the red data, a power for the green data and a power for the blue data are different from one another, and for the changed gamma correction the power of at least one of the red data, the green data or the blue data is changed as compared to the standard gamma correction.

32. The display panel of claim 31, wherein a brightness is the average brightness of the input data.

* * * * *